US005892480A

United States Patent [19]

Killen

[11] Patent Number: 5,892,480

[45] Date of Patent: Apr. 6, 1999

[54] VARIABLE PITCH ANGLE, AXIAL MODE HELICAL ANTENNA

[75] Inventor: William D. Killen, Satellite Beach, Fla.

[73] Assignee: Harris Corporation, Melbourne, Fla.

[21] Appl. No.: 838,546

[22] Filed: Apr. 9, 1997

[51] Int. Cl.[6] ..... H01Q 1/36

[52] U.S. Cl. ..... 343/385

[58] Field of Search ..... 343/895, 713, 343/715, 752

[56] References Cited

U.S. PATENT DOCUMENTS

| | | | |
|---|---|---|---|
| 3,568,205 | 3/1971 | Buxton | 343/749 |
| 3,618,114 | 11/1971 | Dietrich | 343/895 |
| 3,852,759 | 12/1974 | Felsenheld et al. | 343/895 |
| 3,858,220 | 12/1974 | Arnow | 343/802 |
| 3,940,772 | 2/1976 | Ben-Dov | 343/895 |
| 4,011,567 | 3/1977 | Ben-Dov | 343/895 |
| 4,087,820 | 5/1978 | Henderson | 343/752 |
| 4,148,030 | 4/1979 | Foldes | 343/895 |
| 4,161,737 | 7/1979 | Albright | 343/749 |
| 4,163,981 | 8/1979 | Wilson | 343/715 |
| 4,169,267 | 9/1979 | Wong et al. | 343/895 |
| 4,494,117 | 1/1985 | Coleman | 343/895 |
| 4,780,727 | 10/1988 | Seal et al. | 343/895 |
| 5,081,469 | 1/1992 | Bones | 343/895 |
| 5,406,693 | 4/1995 | Egashira et al. | 29/600 |
| 5,432,524 | 7/1995 | Sydor | 343/895 |
| 5,479,182 | 12/1995 | Sydor | 343/895 |

FOREIGN PATENT DOCUMENTS

| | | |
|---|---|---|
| 7-22830 | 1/1995 | Japan . |
| 7-22839 | 1/1995 | Japan . |
| 7-202550 | 8/1995 | Japan . |
| 7-176940 | 12/1995 | Japan . |

*Primary Examiner*—Robert Kim
*Attorney, Agent, or Firm*—Charles E. Wands

[57] ABSTRACT

Optimization of the exchange of energy between a free space wave and current flowing in the conductive helix of an axial mode, helical antenna is achieved by varying the pitch angle of successive turns of the antenna along the axis of the antenna, from a relatively small pitch angle at the base, feed location of the antenna, to a relatively large value at the distal end of the antenna. Pitch angles of successive turns of the antenna are varied in a non-linear manner to correspond to the non-linear manner in which the phase velocity of a wave propagating through the antenna varies relative to the phase velocity of a free space electromagnetic wave. For the case of an axial mode, helical antenna operating at C-band, the pitch angle of said antenna may be varied between 3–8 degrees at the antenna feed point to a 20–30 degrees at its free space-interfacing distal end. The variable pitch angle antenna has a gain versus bandwidth characteristic that contains a plurality of spaced apart peak regions, one of which has a peak gain slightly less than the other. This dual peak gain behavior permits application design trade off between a smaller sized antenna with slightly reduced performance versus a larger sized antenna with slightly higher performance.

20 Claims, 2 Drawing Sheets

VARIABLE PITCH ANGLE, AXIAL MODE HELICAL ANTENNA

FIELD OF THE INVENTION

The present invention relates in general to communication systems, and is particularly directed to a new and improved axial mode, helical antenna configuration, the pitch angle of successive turns of which vary along the axis of the antenna, in such a manner as to optimally match the phase velocity of a (circularly polarized) electromagnetic wave interfaced with (received or launched by) the antenna with the phase velocity of the wave travelling through the antenna, thereby increasing the gain of a helical antenna, relative to a conventional helical antenna of a similar number of turns and size and equivalent axial length.

BACKGROUND OF THE INVENTION

Communication systems that are subject to space and weight limitations, such as mobile, manually deployable configurations, often employ (monofilar or bifilar) axial mode, helical antennas, such as that diagrammatically illustrated at 10 in FIG. 1. By axial mode helical antenna is meant one that is not only physically configured as a helix, but, as an axial mode device for circularly polarized RF signals, has the principal lobe of its radiation pattern extending along the axis or boresight 12 of the helix, as diagrammatically illustrated at 20 in FIG. 2. Axial length is measured along axis 12.

Moreover, the wavelength of such an axial mode, helical antenna is less than the axial dimension of the antenna. For example, the axial dimension of a helix having a pitch angle on the order of nine degrees and having four to five turns is slightly less than a wavelength; a five to twenty-three degree pitch angle, five turn helix has an axial dimension of 1.2 wavelengths. This is in contrast to a helical-configured monopolar or bipolar antenna, such as a whip antenna, which is formed of a helically wound conductor, but does not operate as an axial mode device, and has a wavelength typically larger than the axial length of the antenna, and much larger than the circumference, which is typically on the order of one-one hundredth of a wavelength.

Because the pitch angle of a conventional axial mode, helical antenna is constant along the axis of the antenna (typically on the order of twelve degrees or so), then at any point along the axis of the antenna, the phase velocity of the electromagnetic wave travelling through the antenna will not necessarily match the phase velocity of the free space wave being interfaced with (received or launched by) the antenna. For the case of a received wave, for example, this phase velocity mismatch prevents the incoming free space wave from coherently exciting currents within the antenna. As a result, the gain of the antenna is reduced to value that is less than optimal.

For a non-limiting examples of such conventional helical antenna configurations, including both axial mode devices, and non-axial mode configurations, such as, but not limited to, whip antennas, attention may be directed to the following documentation: U.S. Pat. No. 3,568,205 to Buxton, U.S. Pat. No. 3,858,220 to Arnow, U.S. Pat. No. 4,087,820 to Henderson, U.S. Pat. No. 4,148,030 to Foldes, U.S. Pat. No. 4,161,737 to Albright, U.S. Pat. No. 4,163,981 to Wilson, U.S. Pat. No. 4,169,267 to Wong et al, U.S. Pat. No. 4,780,727 to Seal et al, U.S. Pat. No. 5,081,469 to Bones, U.S. Pat. No. 5,406,693 to Egashira et al, U.S. Pat. No. 5,479,182 to Sydor, U.S. Pat. No. 5,489,916 to Waterman et al, Japanese Publication No. 7-202550 to Oomuro et al, Japanese Publication No. 7-176940 to Oomuro et al, Japanese Publication No. 7-22839 to Tsutsumi, Japanese Publication No. 7-22830 to Yamamoto.

SUMMARY OF THE INVENTION

In accordance with the present invention, the above-described phase velocity mismatch problem for circularly polarized RF energy, in an axial mode, helical antenna is successfully addressed, by varying the pitch angle of successive turns of the antenna along the axis of the antenna, from a relatively small pitch angle at the base, feed location of the antenna, to a relatively large pitch angle value at the distal end of the antenna. The effect of this varying pitch angle is to optimally match the phase velocity of a free space electromagnetic wave interfaced with (received or launched by) the antenna with the phase velocity of the wave travelling through the antenna, thereby increasing the gain of the antenna relative to a conventional helical antenna structure.

Because the relationship with which the phase velocity of a wave propagating through the antenna relative to the phase velocity a free space electromagnetic wave interfaced with the antenna varies along the axis of the helical antenna in a non-linear manner, the pitch angles of successive turns of the antenna are varied in a corresponding linear or non-linear manner. For the case of an axial mode, helical antenna operating at C-band, the pitch angle of the antenna may be varied between a relatively small value on the order of three to eight degrees (and particularly on the order of three to six degrees) at the antenna feed point to a relatively large value on the order of twenty to thirty degrees (and particularly on the order of twenty-three to twenty-six degrees) at its free space-interfacing distal end. The spacing between successive turns may vary from a value on the order of a half-wavelength at the distal end of the antenna to a quarter wavelength or less at the feed point end.

An additional advantage of the variable pitch angle antenna of the invention is the fact that it has a gain versus bandwidth characteristic that contains a plurality of spaced apart peak regions, one of which has a peak gain slightly less than the other. This dual peak gain behavior affords the designer the ability to trade off a smaller sized antenna with slightly reduced performance versus a larger sized antenna with somewhat better performance, depending upon the application in which the antenna will be employed.

DETAILED DESCRIPTION

Figure 1:
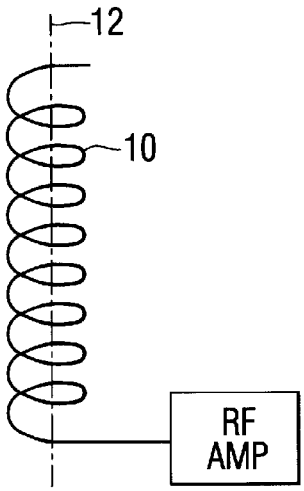
FIG. 1 PRIOR ART
FIG. 1 diagrammatically illustrates a conventional constant pitch angle, axial mode, helical antenna.
Figure 3:
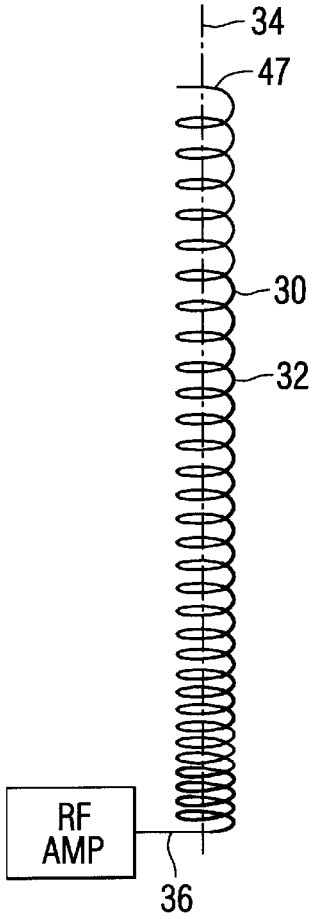
FIG. 3 diagrammatically illustrates a variable pitch angle, axial mode, helical antenna in accordance with the invention.
Figure 2:
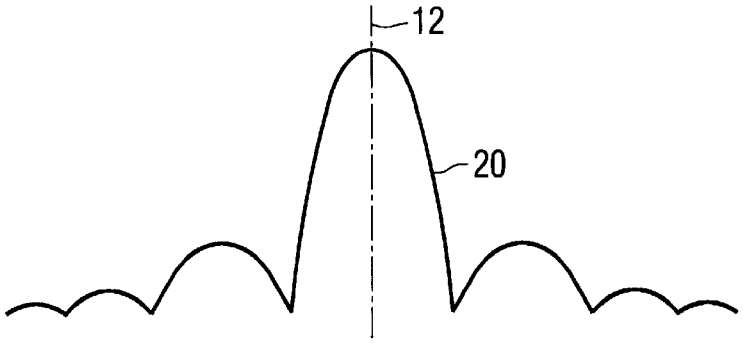
FIG. 2 PRIOR ART
FIG. 2 diagrammatically illustrates the radiation pattern of the axial mode helical antenna of FIG. 1.

Referring now to FIG. 3, a variable pitch angle, axial mode, helical antenna in accordance with the present invention is diagrammatically illustrated at 30 as comprising a (monofilar) conductor 32 helically wound along an axis 34, which coincides with the boresight of the antenna. An RF interface port 36, to which an RF signal may be coupled from upstream RF amplifier circuitry in the case of employing the antenna as an RF wave launching device, or from which an RF output signal may be derived for application to downstream RF signal processing circuitry, when the antenna is employed as a wave-receiving device, is coupled to a feed port 36 at the base of the antenna 30. As a non-limiting example, for axial mode operation at C-band, antenna 30 may have a length on the order of ten inches and a diameter on the order of three-quarters of an inch. Thus, as an axial mode helical antenna operating at C band, the wavelength of interfaced electromagnetic energy is on the order of two inches, which is considerably less than the axial dimension of the antenna.

Figure 4:
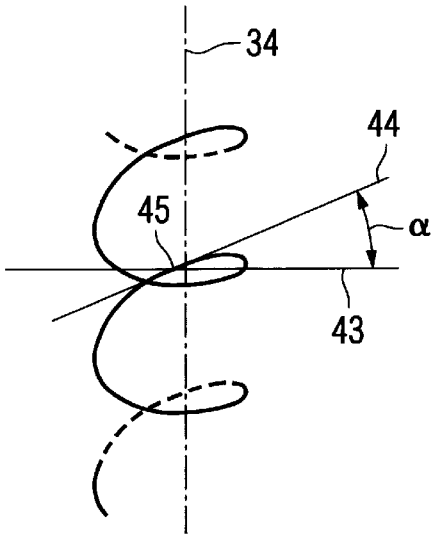
FIG. 4 diagrammatically illustrates how pitch angle is defined as the angle between a plane normal to the antenna's boresight axis and a line tangential to a selected location on the antenna helix.

Pursuant to the invention, at any location along its length, the antenna 30 has a pitch angle that is tailored to optimize the exchange of energy between a free space wave and current flowing in the conductive helix. As diagrammatically illustrated in FIG. 4, the pitch angle is the angle $\alpha$ between a plane 43 normal to the boresight axis 34 and a line 44 tangential to the selected location 45 on the helix. The largest value of pitch angle $\alpha$ is at the distal end 47 of the antenna shown in FIG. 3, while the smallest value of pitch angle $\alpha$ is at the feed port 36. For C-band operation, the pitch angle $\alpha$ at the distal end of the antenna, which the spacing between turns is largest, may have a value on the order of 20–30 degrees (and particularly on the order of 23–26 degrees), while the pitch angle $\alpha$ at the feed port 36, where the spacing between turns is smallest, may have a value on the order of 3–8 degrees (and particularly on the order of 3–6 degrees).

Between these distal and feed locations, the pitch angle along successive turns of the antenna helix 30 varies in accordance with the relationship between the phase velocity of a wave propagating through the antenna and the phase velocity of a free space electromagnetic wave interfaced with the antenna. Parametric measurements along successive turns of the antenna have revealed that this phase velocity variation is not linear. As a consequence, it is preferred that the pitch angles of successive turns of the antenna be varied in a corresponding non-linear manner, so as to optimally match the phase velocity of a free space electromagnetic wave interfaced with (received or launched by) the antenna with the phase velocity of the wave travelling through the antenna. What results is an axial mode, helical antenna that has several more dB of gain than would otherwise be provided by a constant pitch angle configuration of similar axial length. Also, the variable pitch angle helix of the present invention is capable of achieving, in absolute terms, more gain than a helix having a fixed pitch angle.

Figure 5:
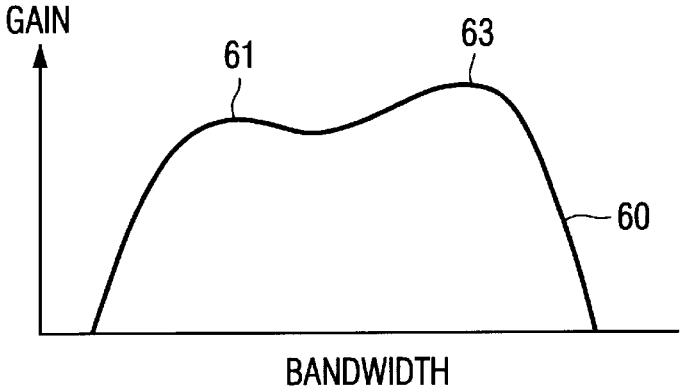
FIG. 5 diagrammatically illustrates a dual peak, gain-bandwidth characteristic of the variable pitch angle antenna of FIG. 3.

In addition to providing increased gain as a result of varying pitch angle, as described above, the axial mode, helical antenna of the invention has a gain versus bandwidth characteristic, that is quite unlike that of a conventional constant pitch angle antenna. In particular, as diagrammatically illustrated in FIG. 5, the gain-bandwidth characteristic shown at 60 in FIG. 5 exhibits a first, lower frequency gain peak 61 that is spaced apart (in frequency) from and has an amplitude that is slightly less than a second, higher frequency gain peak 63. This dual peak gain behavior affords the designer the ability to trade off a smaller sized antenna (wider diameter, lesser number of turns) with slightly reduced performance (associated with peak 61) versus a larger sized antenna (smaller diameter, greater number of turns) with an improvement in performance of a dB or so, depending upon the application in which the antenna will be employed. In a spaceborne or airborne platform, for example, where size and weight are major constraints, the dual peak characteristic of the invention allows the selection of the reduced performance portion of the gain/bandwidth curve, in the deployment of a multi-helix array, in order to satisfy mechanical considerations.

As will be appreciated from the foregoing description, the varying pitch angle axial mode, helical antenna of the present invention not only successfully addresses the above-described phase velocity mismatch problem of and provides increased gain over a conventional constant pitch angle antenna, but has a gain-bandwidth characteristic that contains a plurality of spaced apart peak regions, which allows the designer to trade off a smaller sized antenna with slightly reduced performance versus a larger sized but better performance antenna.

Figure 6:
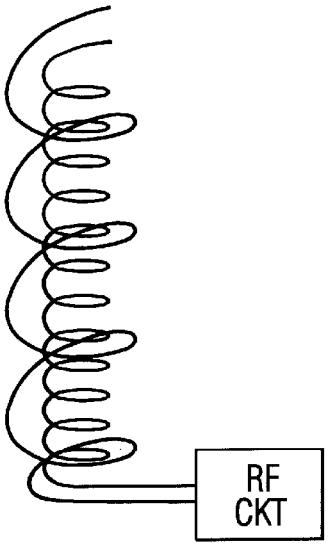
FIG. 6 diagrammatically illustrates a bifilar helix antenna configuration.

Although the present invention has been described for the case of a monofilar structure, it is also applicable to a multifilar helical configuration, such as a bifilar helix, as diagrammatically illustrated in FIG. 6. Further, for improved power conversion efficiency, the variable pitch angle, axial mode helical antenna, whether it be the monofilar structure described above, or a variable pitch angle-configured multifilar structure, may be fed in the manner described in co-pending application Ser. No. 08/777,027, filed Dec. 30, 1996, by Donald Belcher et al, entitled: "Optimization of DC Power to Effective Irradiated Power Conversion Efficiency for Helical Antenna," assigned to the assignee of the present application and the disclosure of which is herein incorporated.

While I have shown and described an embodiment in accordance with the present invention, it is to be understood that the same is not limited thereto but is susceptible to numerous changes and modifications as known to a person skilled in the art, and I therefore do not wish to be limited to the details shown and described herein, but intend to cover all such changes and modifications as are obvious to one of ordinary skill in the art.

What is claimed:

1. A multi-turn axial mode, helical antenna for interfacing an electromagnetic wave having a wavelength less than the axial length of said helical antenna, which extends from a feed location at a base of said helical antenna to a distal end of said helical antenna, said helical antenna comprising a helical winding having the same prescribed diameter along said axial length of said helical antenna, and wherein spacings between and pitch angles of successive turns of said helical winding vary along a line parallel to said axis of said helical from first respective spacing and phase angle values at said feed location, to second respective spacing and phase angle values at said distal location, which are larger than said first respective spacing and phase angle values.

2. A multi-turn axial mode, helical antenna according to claim 1, wherein values of said spacings and pitch angles of successive turns of said helical winding vary in a manner that matches the phase velocity of a free space electromagnetic wave interfaced with said antenna with the phase velocity of a wave traveling through said antenna.

3. A multi-turn axial mode, helical antenna according to claim 1, wherein values of said pitch angles of successive turns of said helical winding vary in a non-linear manner along said axial length of said helical winding.

4. A multi-turn axial mode, helical antenna according to claim 1, wherein values of said spacings of successive turns of said helical winding vary from a value on the order of a half-wavelength at said distal end of said helical winding to a quarter wavelength at said feed location of said helical winding.

5. A multi-turn axial mode, helical antenna according to claim 1, wherein said antenna has a gain versus bandwidth characteristic that contains a plurality of spaced apart peak regions.

6. A multi-turn axial mode, helical antenna according to claim 1, wherein said pitch angles vary from a value on the order of 3–8 degrees at said feed location to a value on the order of 20–30 degrees at said distal end of said helical winding.

7. A multi-turn axial mode, helical antenna according to claim 1, wherein said helical winding has a pitch angle on the order of 23–26 degrees at said distal end thereof.

8. A multi-turn axial mode, helical antenna according to claim 1, wherein said electromagnetic wave is circularly polarized.

9. A multi-turn axial mode, helical antenna according to claim 1, wherein said helical winding comprises a bifilar helix.

10. A method of improving the efficiency and gain of a multi-turn axial mode, helical antenna for interfacing an electromagnetic wave having a wavelength less than the axial length of said helical antenna, which extends from a feed location at a base of said helical antenna to a distal end of said helical antenna, comprising the steps of:

(a) configuring said helical antenna as constant diameter helical winding along said axial length thereof; and (b) varying spacings between and pitch angles of successive turns of said helical winding vary along a line parallel to said axis of said helical from first respective spacing and phase angle values at said feed location, to second respective spacing and phase angle values at said distal location, which are larger than said first respective spacing and phase angle values.

11. A method according to claim 10, step (b) comprises varying values of said spacings and pitch angles of successive turns of said helical winding in a manner that matches the phase velocity of a free space electromagnetic wave interfaced with said antenna with the phase velocity of a wave traveling through said antenna.

12. A method according to claim 10, wherein step (b) comprises varying said pitch angles of successive turns of said helical winding in a non-linear manner along said axial length of said helical winding.

13. A method according to claim 10, wherein step (b) comprises varying said spacings of successive turns of said helical winding from a value on the order of a half-wavelength at said distal end of said helical winding to a quarter wavelength at said feed location of said helical winding.

14. A method according to claim 10, wherein said helical antenna has a gain versus bandwidth characteristic that contains a plurality of spaced apart peak regions.

15. A method according to claim 10, wherein step (b) comprises varying said pitch angles from a value on the order of 3–8 degrees at said feed location to a value on the order of 20–30 degrees at said distal end of said helical winding.

16. A method according to claim 10, wherein step (b) comprises configuring said helical winding to have a pitch angle on the order of 23–26 degrees at said distal end thereof.

17. A method according to claim 10, wherein said electromagnetic wave is circularly polarized.

18. A multi-turn axial mode, helical antenna for interfacing an electromagnetic wave having a wavelength less than the axial length of the antenna, said helical antenna comprising a helical winding having a prescribed diameter said axial length thereof, and wherein spacing between any two successive turns of said helical winding along a first line parallel to said axial length of said helical winding differs from spacing between any two other successive turns along a second line parallel to said axial length of said helical winding, so that successive turns of said antenna have successively different pitch angles.

19. A multi-turn axial mode, helical antenna according to claim 18, wherein spacings between and thereby pitch angles of successive turns of said helical winding vary in a non-linear manner that matches the phase velocity of a free space electromagnetic wave interfaced with said antenna with the phase velocity of a wave traveling through said antenna.

20. A multi-turn axial mode, helical antenna according to claim 18, wherein said helical winding comprises a bifilar helix.

* * * * *